US007050540B2

(12) United States Patent
Wilkins et al.

(10) Patent No.: US 7,050,540 B2
(45) Date of Patent: May 23, 2006

(54) X-RAY MICRO-TARGET SOURCE

(75) Inventors: Stephen William Wilkins, Blackburn (AU); Peter Robert Miller, Carnegie (AU)

(73) Assignee: XRT Limited, Mulgrave (AU)

( * ) Notice: Subject to any disclaimer, the term of this patent is extended or adjusted under 35 U.S.C. 154(b) by 53 days.

(21) Appl. No.: 10/312,294

(22) PCT Filed: Jun. 22, 2001

(86) PCT No.: PCT/AU01/00750

§ 371 (c)(1),
(2), (4) Date: Dec. 20, 2002

(87) PCT Pub. No.: WO01/99478

PCT Pub. Date: Dec. 27, 2001

(65) Prior Publication Data

US 2003/0108155 A1 Jun. 12, 2003

(30) Foreign Application Priority Data

Jun. 22, 2000 (AU) ..... PQ 8312

(51) Int. Cl.
*H01J 35/08* (2006.01)

(52) U.S. Cl. ..... 378/124; 378/125

(58) Field of Classification Search ..... 378/124–126, 378/143

See application file for complete search history.

(56) References Cited

U.S. PATENT DOCUMENTS

| | | | | | |
|---|---|---|---|---|---|
| 3,737,698 | A * | 6/1973 | Carter | ..... | 378/124 |
| 4,017,757 | A * | 4/1977 | DeCou, Jr. | ..... | 378/124 |
| 4,379,977 | A * | 4/1983 | Carmel et al. | ..... | 378/136 |
| 4,618,972 | A * | 10/1986 | Georgiou et al. | ..... | 378/34 |
| 4,622,688 | A * | 11/1986 | Diemer et al. | ..... | 378/143 |
| 4,870,671 | A * | 9/1989 | Hershyn | ..... | 378/124 |
| 5,010,562 | A * | 4/1991 | Hernandez et al. | ..... | 378/125 |
| 6,141,400 | A * | 10/2000 | Schardt et al. | ..... | 378/124 |
| 6,163,590 | A * | 12/2000 | Wilkins | ..... | 378/43 |
| 6,229,876 | B1 * | 5/2001 | Enck et al. | ..... | 378/136 |

* cited by examiner

*Primary Examiner*—Craig E. Church
*Assistant Examiner*—Thomas R. Artman
(74) *Attorney, Agent, or Firm*—Fulwider Patton LLP

(57) ABSTRACT

X-ray generation apparatus including an elongated target body and a mount from which the body projects to a tip remote from the mount. The target body includes a substance that, on being irradiated by a beam of electrons of suitable energy directed onto the target body from laterally of the elongate target body, generates a source of x-ray radiation from a volume of interaction of the electron beam with the target body. The mount provides a heat sink for the target body.

80 Claims, 6 Drawing Sheets

Figure 4. Low resolution SEM image recorded on XL-30 Showing Fe (steel) Needle Tip.

Figure 5. Moderate resolution SEM image recorded on XL-30 Showing Fe (steel) Needle Tip.

Figure 6. High resolution SEM image of FE (steel) needle tip recorded on XL-30 showing tip with almost uniform radium of curvature with about 180nm diameter.

X-RAY MICRO-TARGET SOURCE

RELATED APPLICATIONS

This is a National Phase Application in the United States of America of International Application PCT/AU01/00750 filed 22 Jun. 2001, which claims priority from Australian Patent Application No. PQ 8312 filed 22 Jun. 2000.

FIELD OF THE INVENTION

This invention relates generally to x-ray micro-target sources, and is especially useful as a source excited by an electron beam of an electron microscope for use in x-ray ultramicroscopy. As such, the application of the invention extends generally to the high resolution x-ray imaging of features of very small objects, especially x-ray phase-contrast microscopic imaging, and to compositional mapping of such small objects at very high spatial resolution.

BACKGROUND ART

A known approach to microscopy utilising x-rays is projection x-ray microscopy, in which a focussed electron beam excites and thereby generates a spot x-ray source in a foil or other target. The object is placed in the divergent beam between the target and a photographic or other detection plate.

There have more recently been a number of proposals for using the electron beam of an electron microscope to excite a point source for x-ray microscopy. Integration of an x-ray tomography device directly into an electron microscope was proposed by Sasov, at J. Microscopy 147, 169, 179 (1987). Prototype x-ray tomography attachments for scanning electron microscopes using charge coupled device (CCD) detectors have been proposed in Cazaux et al, J. Microsc. Electron. 14, 263 (1989), Cazaux et al, J. Phys. (Paris) IV C7, 2099 (1993) and Cheng et al *X-ray Microscopy III*, ed. A Michette et al (Springer Berlin, 1992) page 184. Ferreira de Paiva et al (Rev. Sci. Instrum. 67(6), 2251 (June 1996) have developed and studied the performance of a microtomography system based on the Cazaux and Cheng proposals. Their arrangement was an adaptation of a commercially available electron microprobe and was able to produce images at around 10 μm resolution without requiring major alterations to the electron optical column. The authors concluded that a 1 μm resolution in tomography was feasible for their device. All system components and methods of interpretation of image intensity data in these works were based on the mechanism of absorption contrast.

A review article by W. Nixon concerning x-ray microscopy may be found in "X-rays: The First Hundred Years", ed. A Michette & S. Pfauntsch, (Wiley, 1996, ISBN 0.471-96502-2), at pp. 43–60.

International patent publication WO 95/05725 disclosed various configurations and conditions suitable for differential phase-contrast imaging using hard x-rays. Other disclosures are to be found in Soviet patent 1402871 and in U.S. Pat. No. 5,319,694. Practical methods for carrying out hard x-ray phase contrast imaging are disclosed in international patent publication WO 96/31098 assigned to the present applicant. These methods preferably involve the use of microfocus x-ray sources, which could be polychromatic, and the use of appropriate distances between object and source and object and image plane.

Various mathematical and numerical methods for extracting the phase change of the x-ray wavefield at the exit plane from the object are disclosed in the aforementioned WO 96/31098, in Wilkins et al "Phase Contrast Imaging Using Polychromatic Hard X-rays" *Nature* (London) 384, 335 (1996) and in international patent publication WO 98/28950. The examples given in these references primarily related to macroscopic objects and features, and to self-contained conventional laboratory type x-ray sources well separated in space from the sample.

International patent publication WO 98/45853 discloses a sample cell arrangement especially useful for x-ray ultramicroscopy, in particular x-ray imaging, absorption and/or phase contrast, in the evacuated .sample chamber of a scanning electron microscope. A target layer of the sample cell is activated by the SEM electron beam to direct an x-ray beam into the sample space of the cell. One embodiment described has multiple discrete micro-target spots irradiated by the electron beam, an advantageous arrangement in which the effective x-ray source size is determined by target dimensions and not necessarily by focal spot size of the electron microscope. Outstanding difficulties, however, are that the arrangement is very sensitive in two dimensions to e-beam/target alignment, and that background x-ray radiation can be quite substantial if the electron beam also strikes the target substrate.

In a bulk target the x-ray source size and shape is determined by the x-ray generation volume. Typically the x-ray source size for a bulk target is greater than 0.5 micron and so is unsuitable for x-ray sub-micron ultramicroscopy It is an object of the invention to provide an improved x-ray microtarget source that at least addresses one or more of these outstanding problems.

The inventors have appreciated that a target form known in atom probe field ion microscopy may be usefully adapted to the present application.

SUMMARY OF THE INVENTION

It has been further appreciated, in accordance with the invention that the size and shape of the x-ray source as seen by the detector in microscopy is determined by the cross-section of the target at the position where the charged particle beam strikes the target taken parallel to the plane of the detector. While the dimensions of the target are limited in the plane parallel to the detector plane in order to define the x-ray source size, the target can be of arbitrary length in the direction normal to the detector plane. Lengthening the target in the direction normal to the detector plane will therefore increase the amount of target material available for x-ray production and so will increase the efficiency of x-ray production.

Broadening this concept, the invention provides, in a first aspect, x-ray generation apparatus including an elongated target body and a mount from which the body projects to a tip remote from the mount, the target body including a substance that, on being irradiated by a beam of electrons of suitable energy directed onto the target body from laterally of the elongate target body, generates a source of x-ray radiation from a volume of interaction of the electron beam with the target body, said mount providing a heat sink for said target body.

Preferably, the mount is a sufficient heat sink for heat generated in said target body by said beam of electrons as to substantially prevent softening or melting of said target while it is being irradiated by said beam of electrons.

In its first aspect, the invention further extends to an x-ray imaging configuration for use with an exciting electron beam, the configuration including the aforedescribed x-ray source of the invention, a sample mount, x-ray detection means, and means to define a beam of said x-ray radiation directed laterally with respect to said beam of electrons, preferably, a divergent beam emitted generally about said tip away from the mount.

Still further in its first aspect, the invention is directed to a method of generating x-ray radiation comprising directing a beam of electrons of suitable energy onto an elongate target body from laterally of the target body, wherein said target body projects from a mount for the body to a tip remote from the mount, and wherein the target body includes a substance that, on being irradiated by said beam of electrons, generates a source of x-ray radiation.

Preferably; the method further includes defining a beam of said x-ray radiation directed laterally with respect to said beam of electrons, preferably a divergent beam emitted generally about said tip away from said mount. It is emphasised however, that the defined beam of x-ray radiation may, in particular embodiments be generally aligned with or parallel to the beam of electrons.

Preferably, said body is structured whereby, on adjustment of the volume of interaction of the electron beam on the body or an adjustment of the excitation energy of the electron beam, or both, the energy profile of the generated x-ray radiation correspondingly alters.

In a second aspect, the invention provides x-ray generation apparatus. including a target body that on being irradiated by a beam of electrons of suitable energy generates a source of x-ray radiation from a volume of interaction of the electron beam with the target body, wherein said body is structured whereby, on adjustment of said volume of interaction or on adjustment of the excitation energy of the electron beam, or both, the energy profile of the generated x-ray radiation correspondingly alters.

A particular embodiment of the invention embodies both the first and second aspects of the invention.

The elongated target body is preferably an elongated cone with small taper angle, for example an included angle less than 10°, more preferably less than 4°.

The tip of the elongate target body is preferably rounded and may conveniently be a segment of a sphere.

Preferably the useful solid angle of the generated x-ray radiation is an expanding cone of radiation.

Preferably, the beam of electrons is substantially focussed and directed substantially at right angles to the longitudinal axis of the elongate target body. The region of incidence of the electron beam with the target body is preferably adjustable by arranging for the relative positions of the electron beam and the target body to be adjustable.

The mount for the target body is preferably a good electrical conductor or semiconductor to minimise charging up of the target body, and possible consequent drift of the electron beam. The mount is preferably relatively massive heat sink which may conveniently be integral with the target body.

In the second aspect of the invention, the structuring of the target body for providing said variable energy profile of the generated x-ray radiation may be achieved by forming the target body in respective layers for which the characteristic energies of the generated x-ray radiation differ for a given incident electron energy. Alternatively, the target body may be formed in composite material which varies in its x-ray emission characteristics with change in position along the target body.

BRIEF DESCRIPTION OF THE DRAWINGS

The invention will now be further described, by way of example only, with reference to the accompanying drawings, in which.

EMBODIMENTS OF THE INVENTION

Figure 1:
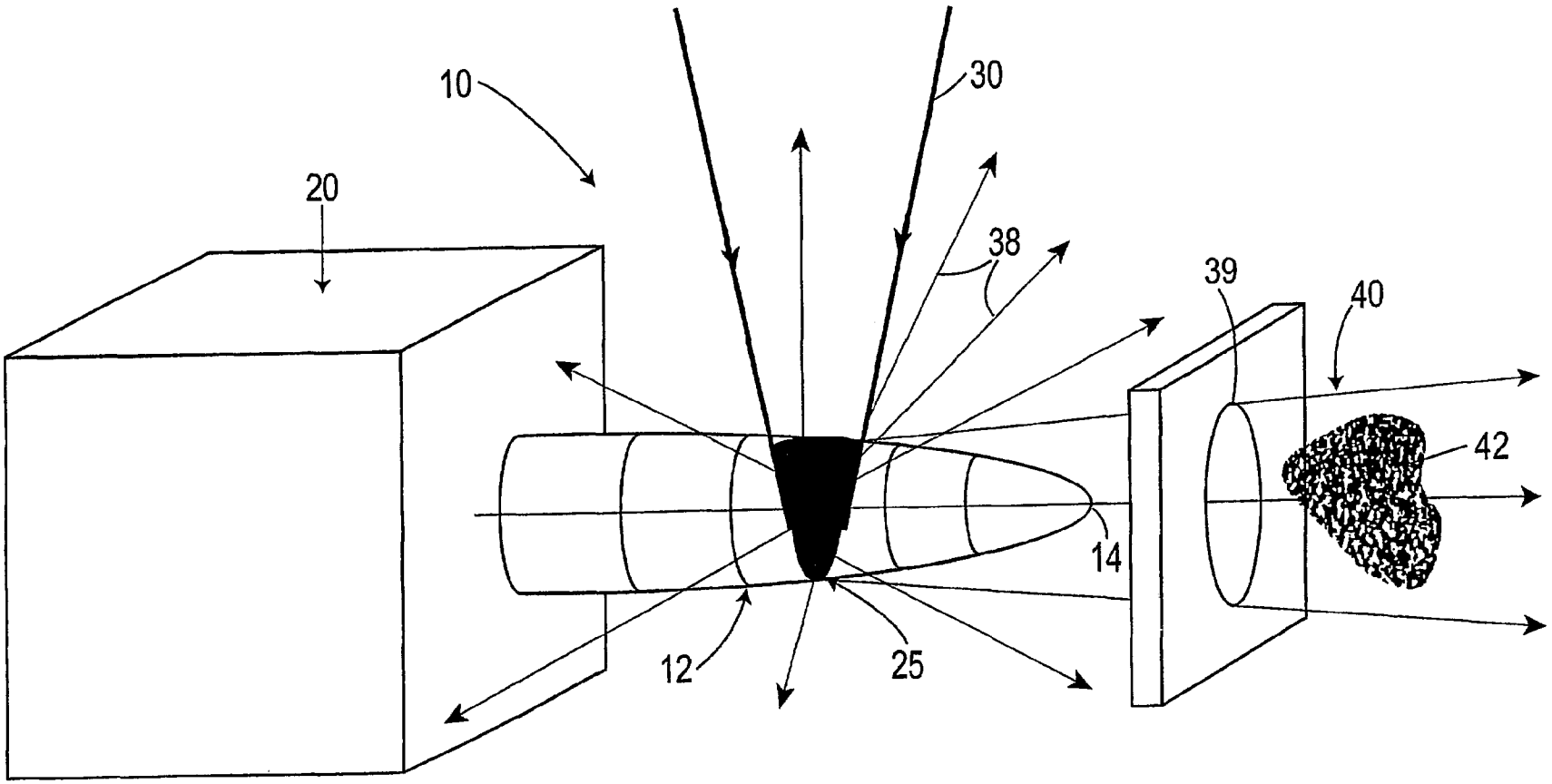
FIG. 1 is a three-dimensional highly diagrammatic and not-to-scale view of x-ray generation apparatus in the form of a micro-target source according to an embodiment of the first aspect of the invention.

The arrangement illustrated diagrammatically in FIG. 1 comprises x-ray generation apparatus including an elongate target body 21 in the form of a solid needle or finger of a substance selected to generate a source of x-ray radiation 38 on being irradiated by a convergent beam of electrons 30 directed and focussed onto the target 12 from laterally of the target. Needle target 12 is an elongate cone of shallow taper angle and a relatively large radius smoothly curved or rounded tip 14. X-ray radiation 38 is emitted in all directions from a volume of interaction 25 of the electron beam 30 with the target body.

An aperture 39 serves as means defining a divergent beam or cone of illumination 40 of x-ray radiation emitted generally about tip 14 and directed laterally with respect to electron beam 30, eg. at 90° to beam 30, which may be utilised, for example, to irradiate a sample 42 that may be placed quite close to the tip 14 of the needle target.

Target 12 is illustrated as a smoothly tapering cone of progressively increasing taper angle towards tip 14, but the taper angle may well be substantially uniform. The principal purpose of the taper is to provide for selection of the effective source size—the cross-section of volume of incidence 25—by adjustment of the electron beam 30 longitudinally of target 12. Tapering also allows a trade off between intensity and resolution by moving the charged particle beam along the target. In practice, a very small included taper angle (eg. %1°) may be desirable. For example, for a typical desired range of effective source size between say 20 nm and 500 nm, and a 1° taper, a target length of the order of 25 micron would be sufficient. Small taper angles and consequent larger target lengths might be desirable. The invention is especially useful in being able to provide an effective source size %200 nm. The target length might conveniently be in the range 10 to 1000 micron, and the included taper angle in the range up to 10°, preferably less than 4°, although these ranges are merely exemplary.

For particular embodiments, the target may not be tapered at all and may be cylindrical. Generally, however, the target cross-section also preferably decreases towards the tip in order to reduce the loss of x-ray intensity due to absorption. However this need not always be the case, a target design where the target cross-section increases towards the tip is also possible. Material outside the volume of x-ray generation and lying between the source and the detector will act as an x-ray and/or electron filter and such material may be deliberately introduced.

Figure 4:
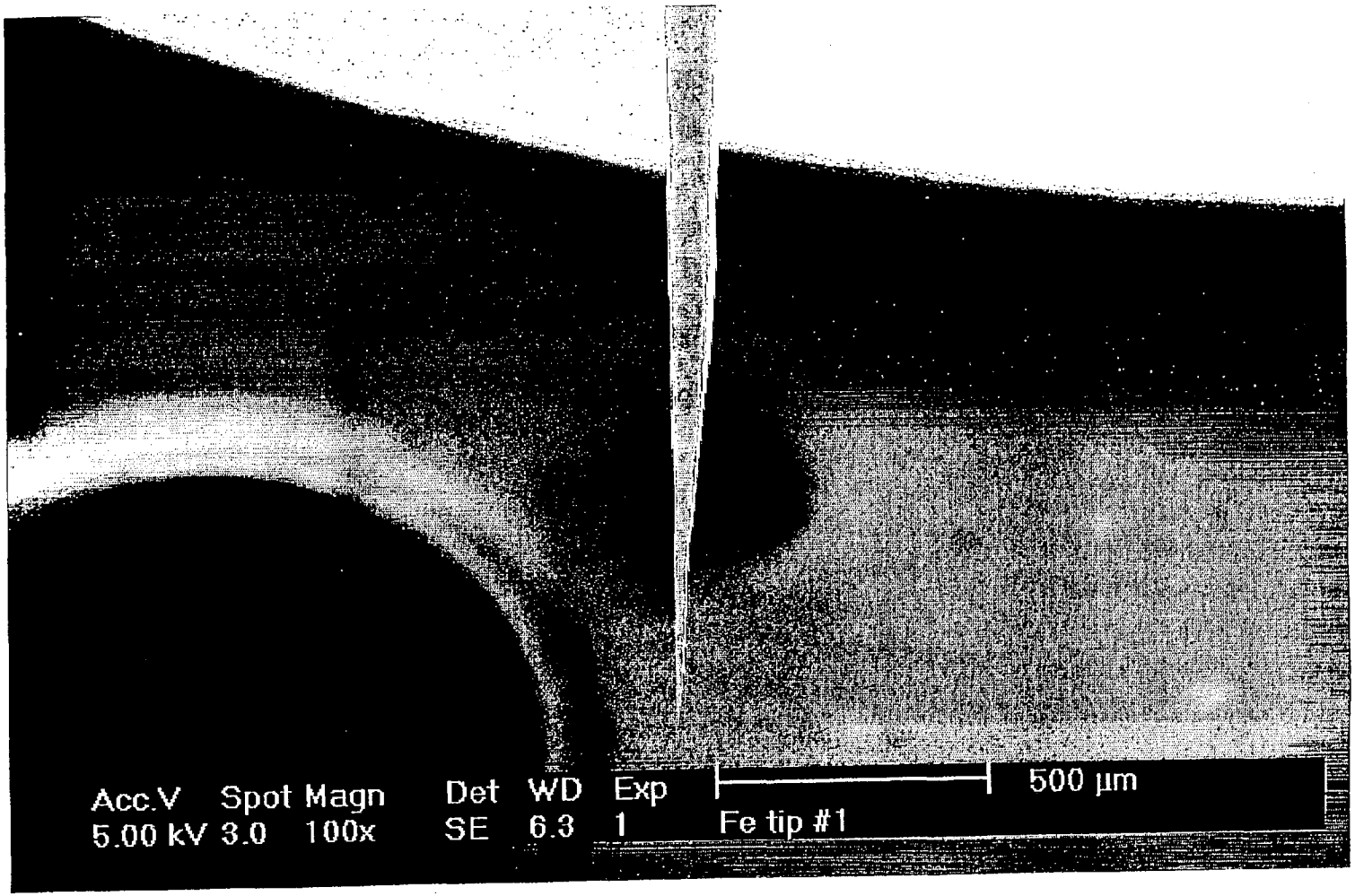
FIGS. 4, 5 and 6 are scanning electron microscope (SEM) images, of successively higher magnification, of a simple steel needle target of a form able to be used for the target body of the embodiment of FIG. 1.
Figure 5:
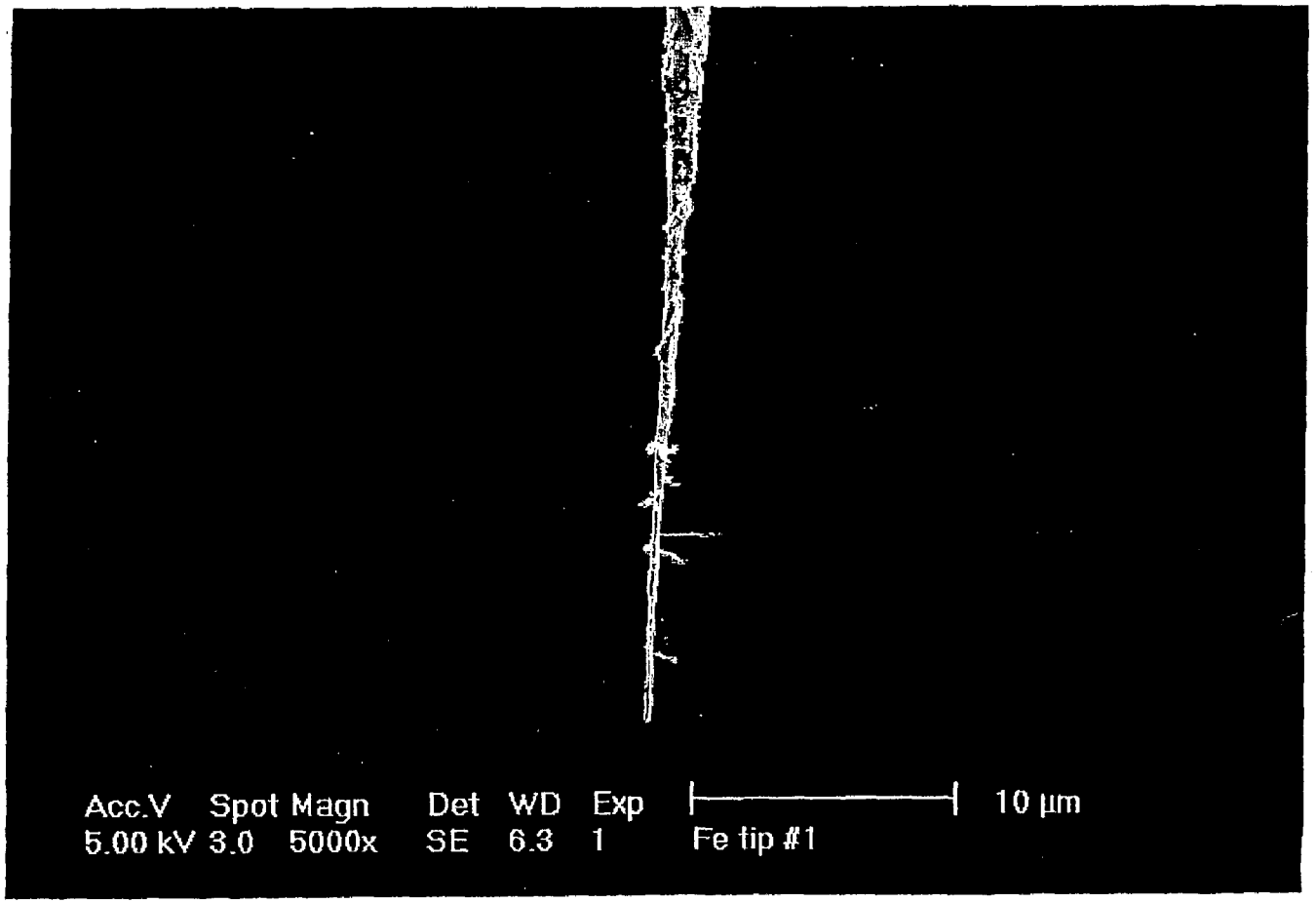
Figure 6:
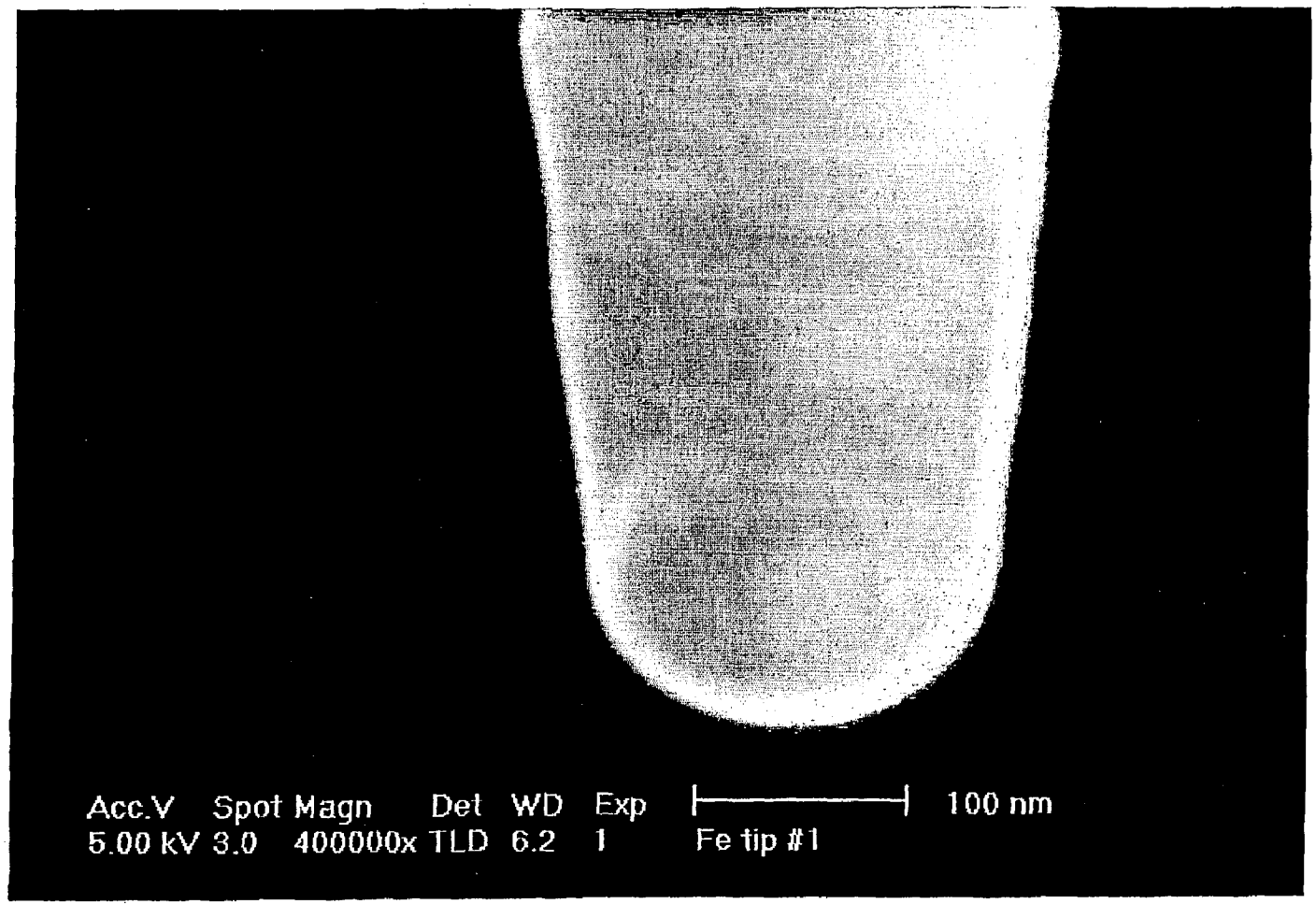

An exemplary needle target formed in steel is depicted in the set of SEM images of FIGS. 4, 5 and 6 at successively higher magnification.

It is desired that the selected material of needle target 12 should be a good electrical and thermal conductor to avoid both electrostatic charging up of the target and undesirable softening or melting. Charging up would cause drift of the electron beam. A sheet of graphite a few microns thick may be mounted at or near the tip of the elongated target to act as an electron absorber to also or alternatively reduce sample charging.

A higher density material is preferred where possible in order to increase the efficiency of x-ray generation.

Needle target 12 projects from a mount 20 which is arranged to provide a secure mechanical mounting but is also preferably a relatively massive body of a material selected to act as a heat sink for the target and prevent the aforementioned softening or melting of target 12 while it is being irradiated by electron beam 30.

The material of mount 20 is also preferably a good electrical conductor to further guard against charging up of the target. It may be convenient for the target and mount to be preformed from an integral piece of a suitably selected material.

The material of the target is of course chosen in accordance with the desired energy/wave length characteristics of the generated x-ray radiation. For example for studying silicon based semiconductor devices, Ta (Mα~1.7 keV) can be useful as silicon is relatively highly transparent to this energy which is just below the Si Kα absorption edge. Table 1 provides some examples of target element selection for different applications.

TABLE 1

Target element selection for different applications

| Application | Requirements | Possible target energies |
|---|---|---|
| Water Window (biological specimens) | Characteristic energies within the 0.283–0.531 keV range | Sc L-0.395, 0.399, 0.348 keV<br>Ti L-0.452, 0.458, 0.395 keV<br>V L-0.510, 0.519, 0.446 keV |
| Semiconductor Al on Si or for general good Si transmission | Energy between the Si and Al K absorption edges (1.559–1.838 keV) | Ta Ma&β-1.710, 1.766 keV<br>W Ma&β-1.775, 1.835 keV |
| Semiconductor Cu on Si | Energy between Si K and Cu L absorption edges (0.953–1.838 keV) | Ta Ma&β-1.710, 1.766 keV<br>W Ma&β-1.775, 1.835 keV<br>AlKα-1.487 keV<br>SiKα-1.740 keV |
| Mainly Monochromatic | Maximum X-ray flux in characteristic line(s) relative to bremsstrahlung | Sc, Ti, V, Cr, Mn, Fe, Co, Ni Kα-energies range from 4.090–7.477 keV<br>Ag Lα-2.984 keV<br>Pd Lα-2.830 keV<br>Mo Lα-2.290 keV<br>Zr Lα-2.024 keV |
| General purpose | Maximum flux regardless of whether it is characteristic lines or bremsstrahlung-dense targets preferred. Choice depends on sample-high energy characteristic lines | Au Mα and bremsstrahlung 2.100 keV (and the rest)<br>Pt Mα and bremsstrahlung 2.051 keV (and the rest)<br>In addition to all monochromatic targets above. |

Figure 2:
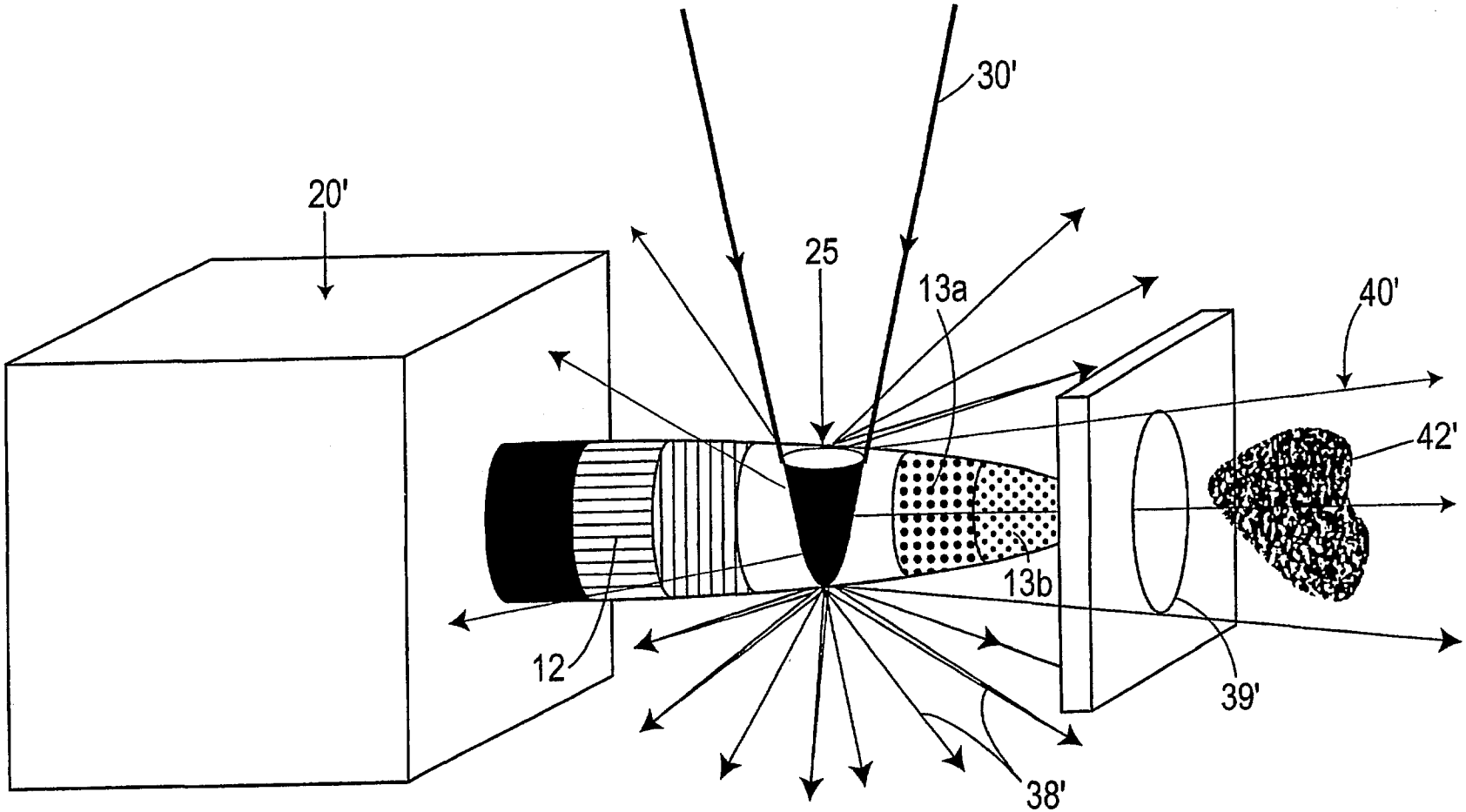
FIG. 2 is a similar view of a further embodiment which also incorporates one form of the second aspect of the invention.

In a modification of the embodiment of FIG. 1 which also incorporates an implementation of the second aspect of the invention, the needle target may be structured so that, on adjustment of the region of incidence 25 of the electron beam on the target, the energy profile of the generated x-ray radiation correspondingly alters. One approach to this is illustrated in FIG. 2 (in which like elements are indicated by like but primed reference numerals), ie. a structure of the needle target body that consists of a series, in the longitudinal or axial direction, of two or more layers 13 *a*, 13 *b* diagrammatically represented by different shading or hatching. With this arrangement, the actual target material can be changed easily and precisely without significant effect on image magnification or position of the image or the detector so as to change the characteristic x-ray energies, by relatively moving the target and/or e-beam in the longitudinal direction of the target. This does not entail a significant change in the position of the effective x-ray source. It will be appreciated that the layers in the target might be chosen so as to optimise heat transfer or so as to provide a filter for low energy x-rays. The thickness of such layers in the longitudinal direction of the target might be in the range 20 nm to tens of microns.

Figure 3:
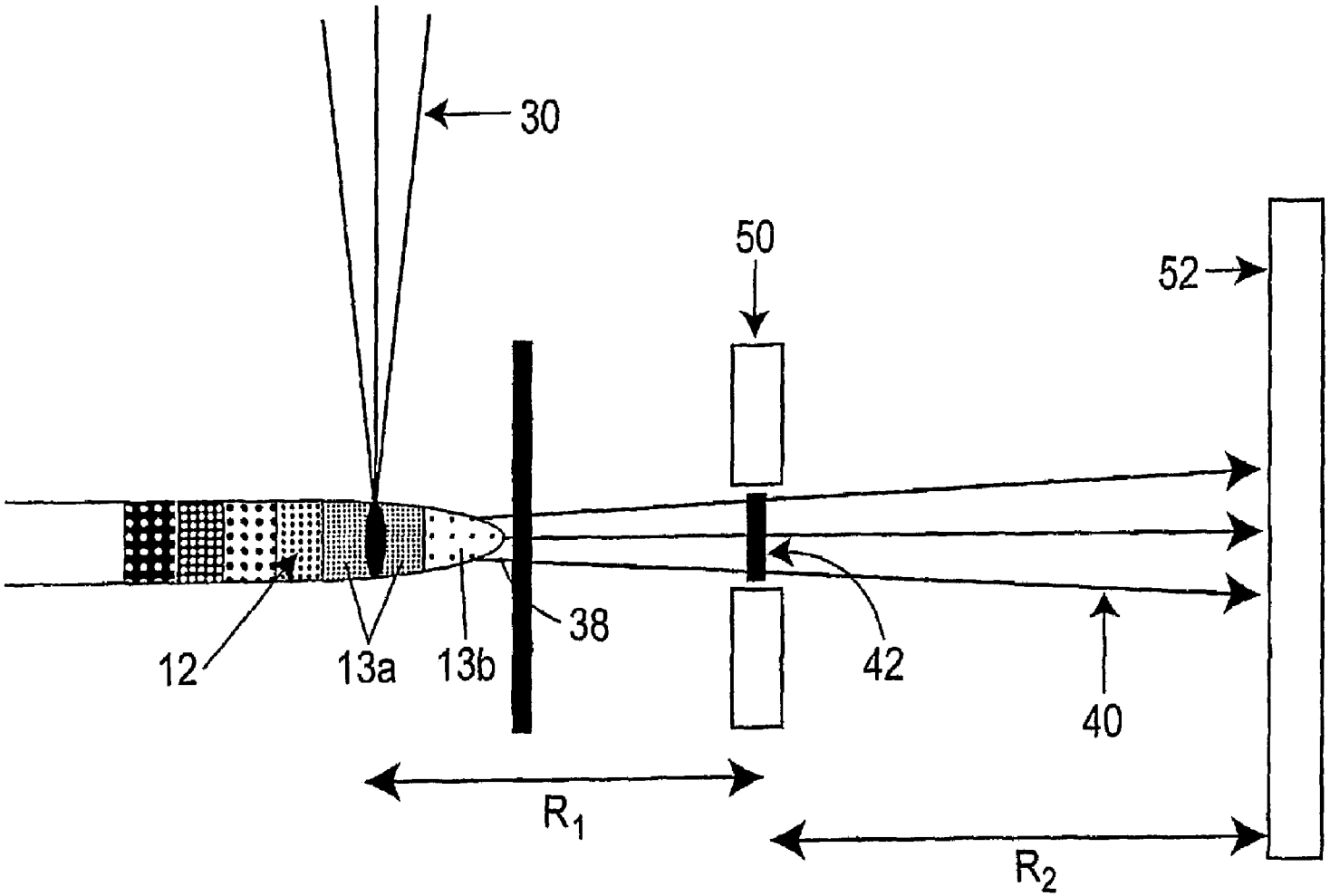
FIG. 3 is a side elevational diagram of an x-ray ultramicroscopy configuration.

It can be seen from FIGS. 1 and 2 how, by appropriate location of beam defining aperture 39, the generated beam 40, 40 ' of x-ray radiation is directed generally symmetrically about the tip 14, 14 ' of the needle target away from the mount 20, 20'. FIG. 3 illustrates how this right-angular configuration can be utilised in an x-ray imaging system incorporating a sample holder 50 close to the needle tip, and a suitable detector 52 such as a CCD detector to receive the x-ray beam after it has traversed the sample. This setup is particularly useful in conjunction with a scanning electron microscope, in which the target and its mount, and the sample holder 50, may be provided within the evacuated chamber of the microscope, and the detector 52 can be removably positioned at a sealed port from the chamber.

It will be appreciated from FIG. 3 that, in general, the size and shape of the target cross-section are determined by the required dimensions of the x-ray source as seen by the detector. The cross-section will be generally circular or approximately so but not exclusively so. Other cross sections such as elliptical, triangular, rectangular, trapesoidal, hexagonal, octagonal, or parts thereof could also be used. The cross-section will be approximately uniform in shape and size within the volume of x-ray generation.

There are a number of significant advantages of the needle target concept and the right angular configuration when applied to x-ray microscopy, including the-following:

- the projected dimension of the x-ray source perpendicular to the beam is well-defined and can be made approximately uniform;
- the radius of curvature of the tip (or cross-sectional diameter) can be made arbitrarily small down to nanometer type scale, see eg. tips used for atomic force microscopy (AFM) and atom ion microprobes resolution in [Ref: Miller et al, "Atom Probe Field In Microscopy". G. D. W. Smith (Clarendon Press 1996), pp. 476ff]. This is a key design parameter that ultimately determines or limits the spatial resolution in x-ray ultramicroscopy;
- dimensions of the effective x-ray source can be easily varied by relatively moving the e-beam (and/or target) along the longitudinal axis of the target so that resolution/flux tradeoff from the target can be optimised;
- transmitted electrons that either pass through or do not interact with the target may be collected in a "beam dump" below the target, thus minimising the generation of unwanted x-rays (ie. production of unwanted background radiation) and making possible improved signal/noise;

the right angle configuration can further improve signal/background because spurious x-rays generated in the SEM column will not reach the x-ray imaging detector 52;

as Bremstrahlung radiation is somewhat forward directed, the right angle geometry offers improved ratio of intensity of x-ray characteristic/continuum radiation. This effect will be smaller for low electron excitation energies and high atomic number targets. It will be larger for high electron excitation energies and low atomic number targets;

a small drift of the e-beam laterally along the target will not significantly affect spatial resolution, image structure and position, or flux;

alignment of the target is comparatively easy because one can track e-beam position along the target. This can be useful in feedback loops to maintain e-beam position and means that only one "search direction" for e-beam ideally need be explored;

only one axis of mechanical drift is important in affecting positional stability of the x-ray source;

the source to sample distance ($R_1$ in FIG. 3) can be made almost arbitrarily small (say to of order a few microns) since by careful design of the sample holder 50 no physical obstructions need occur (cf a 45° foil target where there is a significant excluded region on small $R_1$). Thus, by way of example, for a 300 mm sample 42 to detector 52 distance ($R_2$ in FIG. 3), magnifications approaching, say $300/0.001=3\times10^5$ may be achieved. This means that phase-contrast can in practice be optimised at first maximum with respect to $R_1$ (ie. $R_1^{opt}\sim\frac{1}{2}\lambda u^2$, where u is the spatial frequency of a feature in the object and $\lambda$ is the relevant x-ray wavelength) even for very low energy x-rays (say around 250 eV) and that this potential magnification can be matched to detector resolution to optimise the field-of-view (ie. to avoid over- or under-sampling of the image data) by appropriately varying sample-detector distance $R_2$. Imaging of objects at different resolution or with different fields-of-view (FOV) will in practice benefit greatly from having an instrument with the capability to vary the sample detector distance, $R_2$.

In addition to the normal high-resolution X-ray microscopic imaging mode described above, there is a further highly advantageous mode of operation of x-ray ultramicroscopy, ie. in right-angle mode with needle target and energy analysing detector.

By using the energy analysing mode of the x-ray ultramicroscopic configuration to collect images for energy bands just above and just below an absorption-edge for an element of interest (say +/−5% above and below), the properly scaled difference image for the two energy data sets gives a measure of the relative proportion of that element along the corresponding ray direction through the sample. This particularly relates to cases where absorption contrast is strong, but is also applicable in the case of relatively strong phase-contrast.

A further additional feature of the invention is the combination of these techniques with computerised tomography. In one mode this could involve tomographically analysing the image data for each image separately followed by combination of these tomographic reconstructions to obtain an image which maps the distribution of a particular element or composition in the sample in three dimensions in a similar fashion to a normal tomographic reconstruction.

Other methods of combining multiple sets of tomographic image data for different x-ray energies to obtain 3-dimensional elemental and composition mapping are also possible. A further option is to use the target body as a combined x-ray source and probe for scanning tunnelling microscopy.

For manufacturing the elongate target body 12, it is thought that focused ion beam micromachining may be a practical technique. There may well be advantage using this technique to manufacture both the heat sink mount and the target body 12 itself from a single piece of material so that these components are integral or monolithic. A multi-layer target 20' of the kind illustrated in FIG. 2 might be fabricated by first using multi-layer deposition methods on a flat substrate followed by focussed ion beam micromachining to mill out the target shape from the initial essentially flat multi-layer structure. Suitable deposition methods might include magnetron sputtering, electron beam evaporation, molecular beam epitaxy (MBE) or metal-organic chemical vapour decomposition (CVD).

For particular applications, an array of elongated targets may be fabricated by micromachining notches into a thin foil, producing a "comb" form of target.

The present invention may also be applied to the improved generation of ultra small x-ray sources in conventional x-ray tube designs.

While the long axis of the elongated target has been illustrated and described herein as lying normal to the plane of the detector, other alignments are also possible. One example of an alternative arrangement is a structured target with elliptical cross-section viewed by the detector at say 45° so that the projected source appears circular. This geometry would also reduce x-ray absorption by the target.

The invention claimed is:

1. X-ray generation apparatus including:

an elongated target body and a mount from which the body projects to a tip remote from the mount, said mount providing a heat sink for said target body, the target body including at least one layer, displaced from said tip along a longitudinal axis of the elongated target body, of a substance that, on being irradiated by a beam of electrons of suitable energy directed onto the target body from laterally of the elongate target body, generates a source of x-ray radiation from a volume of interaction of the electron beam with said at least one layer of the target body; and an aperture spaced from said tip in the longitudinal direction of said target body, to define a beam or cone of said x-ray radiation emitted generally about said tip.

2. X-ray generation apparatus according to claim 1 wherein said mount is a sufficient heat sink for heat generated in said target body by said beam of electrons as to substantially prevent softening or melting of said target while it is being irradiated by said beam of electrons.

3. X-ray generation apparatus according to claim 1 wherein said body is structured whereby, on adjustment of the volume of interaction of the electron beam on the body or on adjustment of the excitation energy of the electron beam, or both, the energy profile of the generated x-ray radiation correspondingly alters.

4. X-ray generation apparatus according to claim 3 wherein there are a plurality of said substances arranged as respective layers extending a width dimension of the body and arranged successively in the longitudinal direction of said target body, and wherein the characteristic energies of the x-ray radiation generated by the respective layers differ for a given incident electron energy.

5. X-ray generation apparatus according to claim 4, wherein said beam or cone is a divergent beam.

6. X-ray generation apparatus according to claim 4, wherein said source is of effective source size less than or equal to 200 nm.

7. X-ray generation apparatus according to claim 3 wherein said target body is structured for providing said variable energy profile of the generated x-ray radiation in that the target body is formed in composite material which varies in its x-ray emission characteristics with change in position along the target body.

8. X-ray generation apparatus according to claim 1 wherein said elongated target body is an elongated cone.

9. X-ray generation apparatus according to claim 8 wherein said elongated cone has a taper comprising an included angle less than 10°.

10. X-ray generation apparatus according to claim 9, wherein said taper comprises an included angle less than 4°.

11. X-ray generation apparatus according to claim 8, wherein said tip of the elongated target body is rounded.

12. X-ray generation apparatus according to claim 8, wherein said beam or cone is a divergent beam.

13. X-ray generation apparatus according to claim 8, wherein said source is of effective source size less than or equal to 200 nm.

14. X-ray generation apparatus according to claim 1 wherein said tip of the elongated target body is rounded.

15. X-ray generation apparatus according to claim 1 wherein said tip of the elongated target body is a segment of a sphere.

16. X-ray generation apparatus according to claim 1 wherein said beam or cone is a divergent beam.

17. X-ray generation apparatus according to claim 16 when said divergent beam has a solid angle such that the beam is an expanded cone of radiation.

18. X-ray generation apparatus according to claim 1 further including means whereby said volume of interaction of the electron beam with the target body is adjustable.

19. X-ray generation apparatus according to claim 18 wherein said adjustment is by adjustment of the relative positions of the electron beam and the target body.

20. X-ray generation apparatus according to claim 1, wherein said target body is a good electrical conductor or semiconductor to minimize charging up of the target body.

21. X-ray generation apparatus according to claim 1, wherein said mount is integral with the target body.

22. X-ray generation apparatus according to claim 1, wherein said source is of effective source size less than or equal to 200 nm.

23. A method of generating x-ray radiation comprising:

directing a beam of electrons of suitable energy onto an elongated target body from laterally of the target body, wherein said target body projects from a mount for the body to a tip remote from the mount, and wherein the target body includes at least one layer, displaced from said tip along a longitudinal axis of the elongated target body, of a substance that, on being irradiated by said beam of electrons, generates a source of x-ray radiation, said mount providing a heat sink for said target body and defining a beam or cone of such x-ray radiation emitted generally about said tip by means of an aperture spaced from said tip in the longitudinal direction of said target body.

24. A method according to claim 23 wherein said mount is a sufficient heat sink for heat generated in said target body by said beam of electrons as to substantially prevent softening or melting of said target while it is being irradiated by said beam of electrons.

25. A method according to claim 23 including adjusting the volume of interaction of the electron beam on the body whereby to correspondingly alter the energy profile of the generated x-ray radiation.

26. A method according to claim 23 including adjusting the excitation energy of the electron beam whereby to correspondingly alter the energy profile of the generated x-ray radiation.

27. A method according to claim 26 including providing said target body structured for providing said variable energy profile of the generated x-ray radiation in that there are a plurality of said substances arranged as respective layers extending a width dimension of the body and arranged successively in the longitudinal direction of said target body, and wherein characteristic energies of the x-ray radiation generated by the respective layers differ for a given incident electron energy.

28. A method according to claim 27, wherein said beam or cone is a divergent beam.

29. A method according to claim 26 including providing said target body structured for providing said variable energy profile of the generated x-ray radiation in that the target body is formed in composite material which varies in its x-ray emission characteristics with change in position along the target body.

30. A method according to claim 23 wherein said elongated target body is an elongated cone.

31. A method according to claim 30 wherein said elongated cone has a taper comprising an included angle less than 10°.

32. A method according to claim 31 wherein said taper comprises an included angle less than 4°.

33. A method according to claim 30, wherein said beam or cone is a divergent beam.

34. A method according to claim 23 wherein said beam or cone is a divergent beam.

35. A method according to claim 34 when said beam or cone has a solid angle such that the beam is an expanding cone of radiation.

36. A method according to claim 23 including adjusting said volume of interaction of the electron beam with the target body.

37. A method according to claim 36 wherein said adjustment is by adjustment of the relative positions of the electron beam and the target body.

38. A method according to claim 23 wherein said mount is integral with the target body.

39. X-ray generation apparatus comprising:

an elongated target body, the target body being an elongated cone having a length and a width and formed of respective layers extending substantially wholly across the width of the body and arranged successively in the longitudinal direction of said target body, each layer comprising a substance that, on being irradiated by a beam of electrons of suitable energy directed onto the target body from laterally of the elongated target body, generates a source of x-ray radiation from a volume of interaction of the electron beam with the respective layer; and a mount from which the body projects to a tip remote from the mount, said mount providing a heat sink for said target body; and wherein the characteristic energies of the x-ray radiation generated by the respective layers differ for a given incident electron energy.

40. X-ray generation apparatus according to claim 39, wherein said mount is a sufficient heat sink for heat generated in said target body by said beam of electrons as to substantially prevent softening or melting of said target while it is being irradiated by said beam of electrons.

41. X-ray generation apparatus according to claim 39, wherein said elongated cone has a taper comprising an included angle less than 10°.

42. X-ray generation apparatus according to claim 41, wherein said taper comprises an included angle less than 4°.

43. X-ray generation apparatus according to claim 39, wherein said tip of the elongated target body is rounded.

44. X-ray generation apparatus according to claim 39, wherein said tip of the elongated target body is a segment of a sphere.

45. X-ray generation apparatus according to claim 39, wherein said x-ray radiation is a divergent beam.

46. X-ray generation apparatus according to claim 45, wherein said divergent beam is directed laterally with respect to said beam of electrons about said tip.

47. X-ray generation apparatus according to claim 45, wherein said divergent beam has a solid angle such that the beam is an expanding cone of radiation.

48. X-ray generation apparatus according to claim 39, further including means whereby said volume of interaction of the electron beam with the target body is adjustable.

49. X-ray generation apparatus according to claim 48, wherein said adjustment is by adjustment of the relative positions of the electron beam and the target body.

50. X-ray generation apparatus according to claim 39, wherein said target body is a good electrical conductor or semiconductor to minimize charging up of the target body.

51. X-ray generation apparatus according to claim 39, wherein said mount is integral with the target body.

52. X-ray generation apparatus according to claim 39, wherein said source is of effective source size less than or equal to 200 nm.

53. A method of generating x-ray radiation comprising directing a beam of electrons of suitable energy onto an elongate target body from laterally of the target body, wherein said target body projects from a mount for the body to a tip remote from the mount, and wherein the target body is an elongated cone having a length and a width and is formed of respective layers extending substantially across the width of the body and arranged successively in the longitudinal direction of said target body, each layer comprising a substance that, on being irradiated by said beam of electrons, generates a source of x-ray radiation, said mount providing a heat sink for said target body, wherein the characteristic energies of the x-ray radiation generated by the respective layers differ for a given incident electron energy.

54. A method according to claim 53 wherein said mount is a sufficient heat sink for heat generated in said target body by said beam of electrons as to substantially prevent softening or melting of said target while it is being irradiated by said beam of electrons.

55. A method according to claim 53 including adjusting the volume of interaction of the electron beam on the body whereby to correspondingly alter the energy profile of the generated x-ray radiation.

56. A method according to claim 53 wherein said elongated cone has a taper comprising an included angle less than 10°.

57. A method according to claim 56 wherein said taper comprises an included angle less than 4°.

58. A method according to claim 53 further including defining a divergent beam of said radiation emitted by said target body.

59. A method according to claim 58 wherein said divergent beam is directed laterally with respect to said beam of electrons about said tip.

60. A method according to claim 58 wherein said divergent beam has a solid angle such that the beam is an expanding cone of radiation.

61. A method according to claim 53 including adjusting said volume of interaction of the electron beam with the target body.

62. A method according to claim 61 wherein said adjustment is by adjustment of the relative positions of the electron beam and the target body.

63. A method according to claim 53 wherein said mount is integral with the target body.

64. X-ray generation apparatus including:

an elongated target body and a mount from which the body projects to a tip remote from the mount, the target body including a substance that, on being irradiated by a beam of electrons of suitable energy directed onto the target body from laterally of the elongate target body, generates a source of x-ray radiation from a volume of interaction of the electron beam with the target body, said mount providing a heat sink for said target body, and wherein said elongated target body is an elongated cone having a taper with an included angle less than 10°.

65. X-ray generation apparatus according to claim 64, wherein said taper comprises an included angle less than 4°.

66. A method of generating x-ray radiation, comprising:

directing a beam of electrons of suitable energy onto an elongated target body from laterally of the target body, wherein said target body projects from a mount for the body to a tip remote from the mount, and wherein the target body includes a substance that, on being irradiated by said beam of electrons, generates a source of x-ray radiation, said mount providing a heat sink for said target body, and wherein said elongated target body is an elongated cone having a taper with an included angle less than 10°.

67. A method according to claim 66, wherein said taper comprises an included angle less than 4°.

68. X-ray generation apparatus comprising:

an elongated target body, the target body having a length and a width and formed of respective layers extending substantially wholly across the width of the body and arranged successively in the longitudinal direction of said target body, each layer comprising a substance that, on being irradiated by a beam of electrons of suitable energy directed onto the target body from laterally of the elongated target body, generates a source of x-ray radiation from a volume of interaction of the electron beam with the respective layer; and a mount from which the body projects to a tip remote from the mount, said mount providing a heat sink for said target body; and wherein the characteristic energies of the x-ray radiation generated by the respective layers differ for a given incident electron energy, and said x-ray radiation is a divergent beam directed laterally with respect to said beam of electrons about said tip.

69. X-ray generation apparatus according to claim 68, wherein said mount is a sufficient heat sink for heat generated in said target body by said beam of electrons as to substantially prevent softening or melting of said target while it is being irradiated by said beam of electrons.

70. X-ray generation apparatus according to claim 68, wherein said elongated target body is an elongated cone.

71. X-ray generation apparatus according to claim 70, wherein said elongated cone has a taper comprising an included angle less than 10°.

72. X-ray generation apparatus according to claim 68, wherein said tip of the elongated target body is rounded.

73. X-ray generation apparatus according to claim 68, wherein said divergent beam has a solid angle such that the beam is an expanding cone of radiation.

74. X-ray generation apparatus according to claim 68, further including means whereby said volume of interaction of the electron beam with the target body is adjustable.

75. X-ray generation apparatus according to claim 68, wherein said source is of effective source size less than or equal to 200 nm.

76. A method of generating x-ray radiation comprising directing a beam of electrons of suitable energy onto an elongate target body from laterally of the target body, wherein said target body projects from a mount for the body to a tip remote from the mount, and wherein the target body has a length and a width and is formed of respective layers extending substantially across the width of the body and arranged successively in the longitudinal direction of said target body, each layer comprising a substance that, on being irradiated by said beam of electrons, generates a source of x-ray radiation, said mount providing a heat sink for said target body, wherein the characteristic energies of the x-ray radiation generated by the respective layers differ for a given incident electron energy, and said x-ray radiation is a divergent beam directed laterally with respect to said beam of electrons about said tip.

77. A method according to claim 76 wherein said mount is a sufficient heat sink for heat generated in said target body by said beam of electrons as to substantially prevent softening or melting of said target while it is being irradiated by said beam of electrons.

78. A method according to claim 76 including adjusting the volume of interaction of the electron beam on the body whereby to correspondingly alter the energy profile of the generated x-ray radiation.

79. A method according to claim 76 wherein said elongated target body is an elongated cone.

80. A method according to claim 79 wherein said elongated cone has a taper comprising an included angle less than 10°.

* * * * *

UNITED STATES PATENT AND TRADEMARK OFFICE

CERTIFICATE OF CORRECTION

PATENT NO. : 7,050,540 B2
APPLICATION NO. : 10/312294
DATED : May 23, 2006
INVENTOR(S) : Stephen William Wilkins et al.

It is certified that error appears in the above-identified patent and that said Letters Patent is hereby corrected as shown below:

Column 4,
Line 24, delete "target body 21" and insert --target body 12--.
Line 54, delete "%200" and insert --≤200--.

Signed and Sealed this

Fifth Day of December, 2006

JON W. DUDAS
*Director of the United States Patent and Trademark Office*